United States Patent [19]

Brieger

[11] Patent Number: 4,497,366

[45] Date of Patent: Feb. 5, 1985

[54] PACKER ACTUATED VENT ASSEMBLY

[75] Inventor: Emmet F. Brieger, Albuquerque, N. Mex.

[73] Assignee: Geo Vann, Inc., Houston, Tex.

[21] Appl. No.: 581,339

[22] Filed: Feb. 17, 1984

Related U.S. Application Data

[62] Division of Ser. No. 384,578, Jun. 3, 1982, abandoned.

[51] Int. Cl.[3] ..... E21B 33/129; E21B 34/12; E21B 43/11

[52] U.S. Cl. ..... 166/150; 166/133; 166/188; 166/332

[58] Field of Search ..... 166/150, 126, 133, 142, 166/143, 185, 188, 332, 334; 175/4.56

[56] References Cited

U.S. PATENT DOCUMENTS 3,112,795 12/1963 Keithahn ..... 166/120
4,040,485 8/1977 Vann et al. ..... 166/334 X
4,299,287 11/1981 Vann et al. ..... 175/4.56 X

*Primary Examiner*—Stephen J. Novosad
*Assistant Examiner*—Thuy M. Bui

[57] ABSTRACT

A packer actuated vent assembly comprising an outer barrel attached to a packer body, and a mandrel extension attached to the lower end of the mandrel of the packer. A valve means on the mandrel extension has a slidable valve element which slidably engages a medial portion of the outer peripheral surface of the mandrel and normally is in the opened position. The valve element has a boss thereon which engages a shoulder on the barrel and is thereby moved from the opened to the closed position when the packer mandrel, and therefore the mandrel extension, is properly manipulated to seat the packer. This combination of elements enables a tubing string to be run downhole into a borehole with the tubing string in the open configuration, so that fluid contained within the annulus flows through the opened valve means into the tubing string, thereby balancing the fluid pressure on either side of the tubing string; and when the packer is set, the interior of the tubing string is isolated from the borehole annulus.

15 Claims, 6 Drawing Figures

PACKER ACTUATED VENT ASSEMBLY

This is a division of application Ser. No. 384,578, filed Jun. 3, 1982 now abandoned.

REFERENCE TO RELATED PATENT APPLICATIONS

Reference is made to the previous Roy R. Vann U.S. Pat. Nos., 3,871,448; 3,931,855; 4,040,485; and 4,151,880 for further background of this invention, and to the references cited therein.

BACKGROUND OF THE INVENTION

There are many instances when it is desirable to run a tool string downhole into a borehole with a lower end portion of the tubing string being opened to the flow of well fluids from the borehole so that no differential in hydrostatic head is developed. In a producing well, it may be desirable to reperforate the existing producing formation or to perforate another production zone within the well. In such a situation, a hydrostatic head of drilling mud is used to maintain a bottomhole pressure that is greater than the formation pressure to insure that the well is under control at all times and thereby prevent any blowout. If a sufficient hydrostatic head were not established, the well could start "kicking" during the new perforating.

The general tubing conveyed perforation technique includes a tubing string with a closed vent assembly and perforating gun. The tubing string is run into the well substantially dry with only a small amount of fluid in the bottom of the string to cushion the impact of a bar dropped through the string to detonate the perforating gun. Thus, the vent assembly in the tool string is run into the well in the closed position. However, where it is necessary to maintain the hydrostatic head as in a producing well, the lowering of a dry tubing string into the well would reduce the hydrostatic head so as to possibly cause the loss of control over the well. Thus, it is desirable to run the tubing string into the well "wet" with a vent assembly open whereby well fluids can run into the tubing string to maintain the hydrostatic head. Further, if the well should start "kicking", the open vent assembly permits circulation down through the tubing and into the well to provide further means to kill the well at any time.

For example, often in a dual formation well where the production fluid from the two formations can be co-mingled, the lower zone is perforated and tested and then gently killed with calcium chloride and water such that the completion will not be damaged. If one were to go back into the well with dry tubing, there would be no means to maintain the hydrostatic head or to circulate through the tubing string such that the lower formation would start producing before the dry tubing string reached the location of the upper formations to be perforated. This would occur due to the reduction of the hydrostatic head to a value lower than the formation pressure causing the lower formation to start producing.

The present invention provides a means whereby a perforating gun can be run downhole on the end of a tubing string along with a packer actuated vent assembly held in the open position and which can be subsequently moved to the closed position upon the setting of the packer. Additionally, there is another vent assembly included in the tool string below the packer which can be moved from the closed position to the open position at any subsequent time such as just prior to the detonation of the perforating gun. This unique combination enables an extremely large casing type perforating gun to be run downhole with the tubing string open to the flow of well fluids whereby there is a zero back pressure on the tubing string. After the tool string has been positioned downhole in the borehole, the interior of the tool string can be isolated from the fluids contained within the casing annulus by closing the packer actuated vent assembly. Once the gun is suspended downhole adjacent to the production formation, the second vent assembly is moved into the open position and the gun is detonated at some subsquent time.

Further, once the packer is in position and can be set, the present invention provides the option of lowering the hydrostatic head in the tubing string by displacing the well fluids in the tubing string with another fluid such as nitrogen. As the nitrogen is pumped down the tubing string, the well fluid in the tubing string are displaced through the open packer actuated vent assembly of the present invention. Once the desired hydrostatic head is reached, as for example to obtain an underbalance, the packer actuated vent may be closed and the nitrogen bled off to obtain the desired hydrostatic head in the tubing string to provide the desired pressure differential for backsurging. The underbalance or pressure differential can also be achieved by swabbing the tubing string dry after the packer actuated vent assembly has been closed.

In the prior art, sliding sleeves actuated by wireline have been used to permit flow into the tubing string. Such a sliding sleeve is manufactured by Baker Oil Tools. However, such sliding sleeves are not dependable and do not always seal. Further, the wireline can be blown out of the hole and become tangled. Also, it is cheaper to use a vent assembly in the tool string which can be actuated by the setting of the packer than use a wireline operated sleeve.

SUMMARY OF THE INVENTION

The present invention comprehends both method and apparatus for completing boreholes. According to the method of the present invention, a packer device is connected to a tubing string and an open vent assembly is associated with the packer device. The normally open vent assembly is moved to the closed position when the packer device is set downhole in the borehole.

A second vent assembly, normally in the closed position, is connected between a perforating gun and the packer-actuated vent assembly. The entire tool string is run downhole with the first vent assembly being in the open position. When the packer is set, the upper vent assembly is moved to the closed position, thereby isolating the interior of the tool string from the borehole annulus. At some subsequent time, the lower vent assembly is moved to the open position and the gun fired when it is desired to complete the well.

The method of the present invention is carried out by the provision of a packer actuated vent assembly having an outer barrel connected to the outer barrel of the packer, and a mandrel extension connected to the lower end of the mandrel of the packer device. A sliding valve element sealingly engages a radial port formed in the mandrel, and when the packer is set, the sliding valve element is moved from the open to the closed position relative to the port, thereby precluding flow therethrough. Therefore, when running into the borehole, flow can occur from the casing annulus, into the outer barrel, through the open port, up through the packer mandrel, up through the upper tubing, and to the surface of the ground, and thereafter, the tubing interior is isolated from well fluids.

Accordingly, a primary object of the present invention is the provision of a packer actuated vent assembly which is moved from the normally open to the closed position when the packer is set downhole in a borehole.

Another object of this invention is the provision of a packer actuated vent assembly having a slidable valve element associated therewith and which is closed in response to the setting of a packer.

A further object of this invention is to provide a method of completing a borehole, wherein a packer actuated valve assembly equalizes the pressure between the casing annulus and tubing interior before the packer is set, and thereafter the interior of the tubing string is maintained isolated from the annulus.

A still further object of this invention is the provision of a vent assembly which is actuated to the closed position in response to the setting of a retrievable packer.

Another and still further object of this invention is the provision of both method and apparatus by which a vent assembly is moved to the closed position by utilizing the movement of the tubing string required in setting a retrievable packer.

Another object of the present invention is the provision of an open-to-closed packer actuated vent assembly permitting circulation through the tubing string as it is lowered into the well.

These and various other objects and advantages of the invention will become readily apparent to those skilled in the art upon reading the following detailed description and claims and by reference to the accompanying drawings.

The above objects are attained in accordance with the present invention by the provision of a method of completing a well for use with apparatus fabricated in a manner substantially as described in the above abstract and summary.

DETAILED DESCRIPTION OF THE PREFERRED EMBODIMENT

Figure 1:
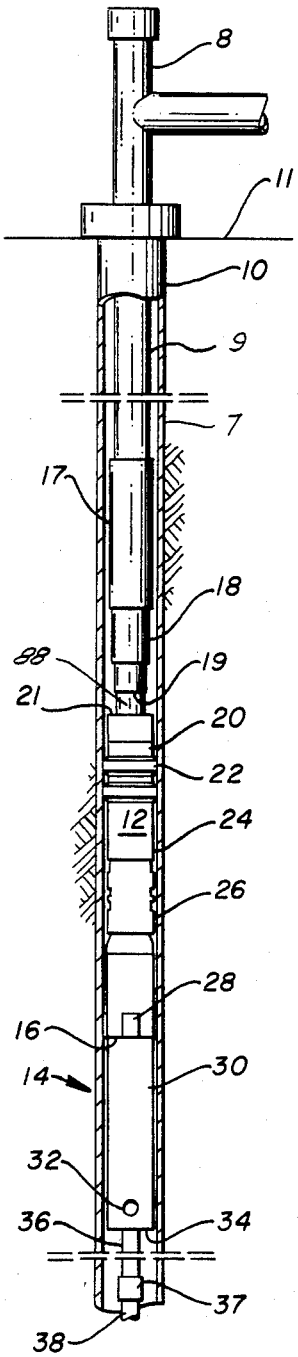
FIG. 1 is a vertical, part cross-sectional, broken view of a borehole formed into the surface of the earth.

FIG. 1 discloses a well head 8 connected to the illustrated borehole 10. Within the borehole there is disclosed a retrievable packer 12 connected to a packer actuated vent assembly 14 made in accordance with the present invention.

The packer 12 can take on any number of different forms so long as it is provided with a hollow mandrel for conducting flow of fluid axially therethrough, and so long as the mandrel is reciprocated relative to the packer body while the packer is being set. As for example, a Baker Lok-Set retrievable casing packer, product No. 642-12 page 498, Baker Oil Tool 1970-71 catalog, Baker Oil Tools, Los Angeles, Calif. Other packer apparatus which can be used with the present invention are exemplified by the patent to Brown, U.S. Pat. No. 2,893,492, or Keithahn, U.S. Pat. No. 3,112,795.

As illustrated in FIG. 1, in conjunction with some of the remaining figures of the drawings, packer 12 includes a packer body 20, hollow mandrel 88, packer rubbers 22, upper and lower slips 24, 26 and drag blocks 28. Interface 16 of the lower end of body 20 defines a shoulder of a threaded connection effected by the lower threaded marginal terminal end of the packer body 20 and the upper threaded marginal terminal end of the vent assembly 14. Sub 17 above packer 12 is attached to coupling member 18 of the mandrel 88 of the packer 12 so that the packer 12 can be series connected and supported by the illustrated tubing string 9. The lower edge portion 19 of the mandrel coupling 18 is movable towards the upper portion of body 20 of the packer 12 until the lower edge portion 19 abuts upper edge portion 21 of packer body 20, thereby causing the packer rubbers 22 to be set within the casing 7. Radially disposed slips 24 and 26 of packer 12 are forced in an outward direction by movement of the mandrel 88 so as to anchor the packer 12 to the interior surface of the wall of casing 7. Drag blocks 28 on packer 12 frictionally engage casing 7 to prevent movement of the packer body 20 relative to the casing 7 while packer mandrel 88 is being manipulated.

Figure 2:
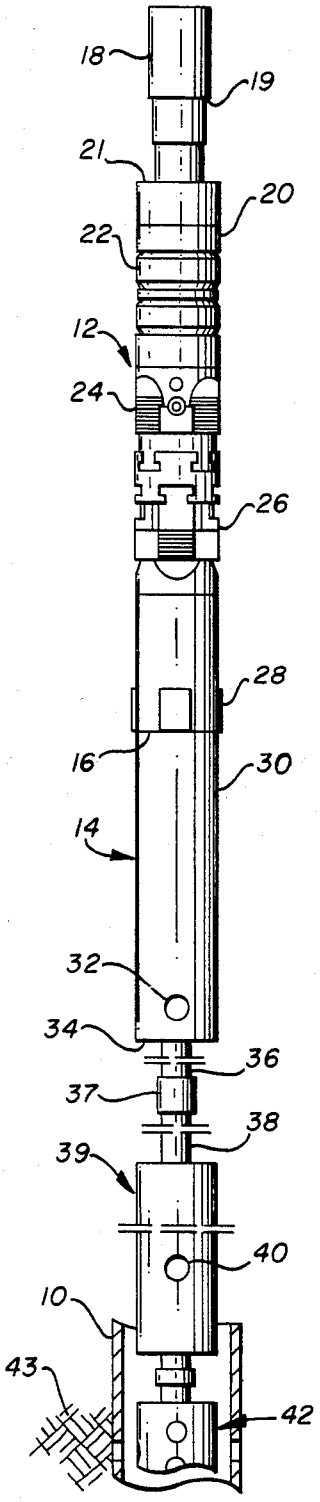
FIG. 2 is an enlarged, broken, side elevational view of part of the apparatus disclosed in FIG. 1.

The vent assembly 14 of the present invention comprises a cylindrical barrel 30 having spaced radial ports 32 located intermediate the downwardly opening peripheral edge portion 34 of barrel 30 and the lower end 16 of body 20 of packer 12; and, a mandrel extension 36 having a lower marginal end threadingly engaging a sub or coupling 37 for connection of the vent assembly 14 into a pipe string 38 so that a perforating or jet gun 42 or the like can be run downhole into the borehole 10 and positioned adjacent to a hydrocarbon containing formation 43 shown in FIG. 2 (when it is desired to complete the well).

Figure 3:
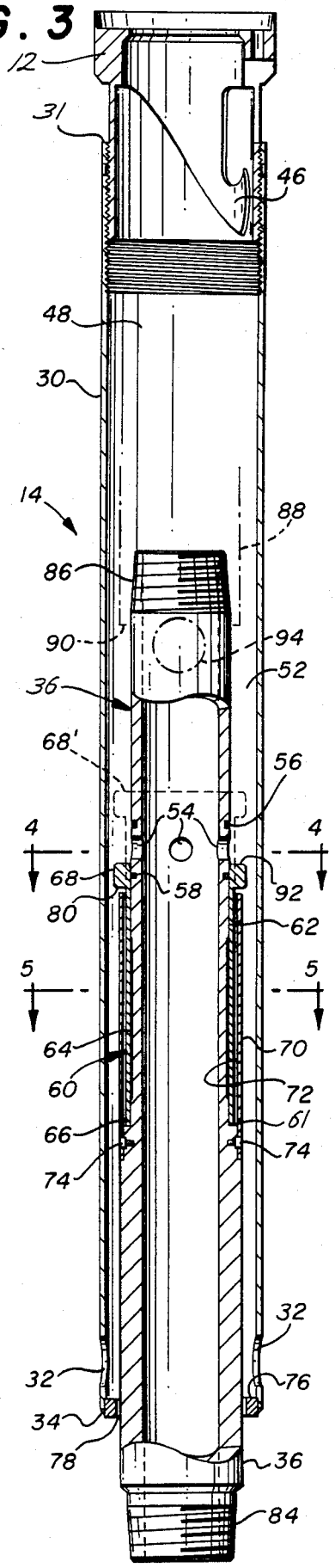
FIG. 3 is an enlarged, longitudinal, cross-sectional view of part of the apparatus disclosed in FIG. 2.
Figure 4:
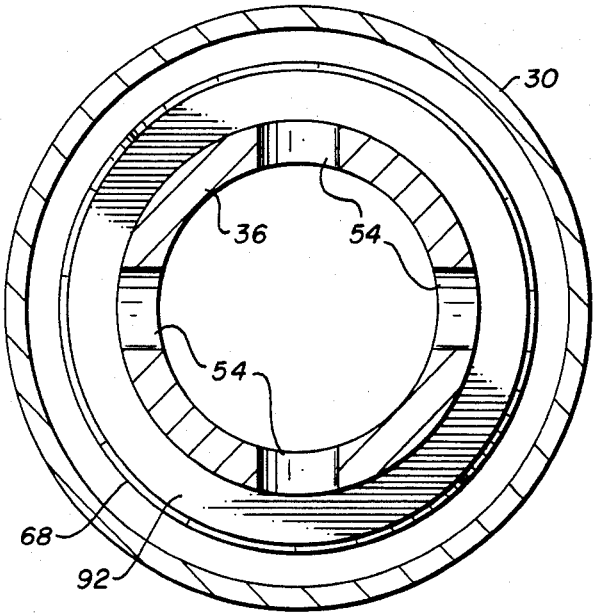
FIGS. 4 and 5 are cross-sectional views taken along lines 4—4 and 5—5 of FIG. 3.
Figure 5:
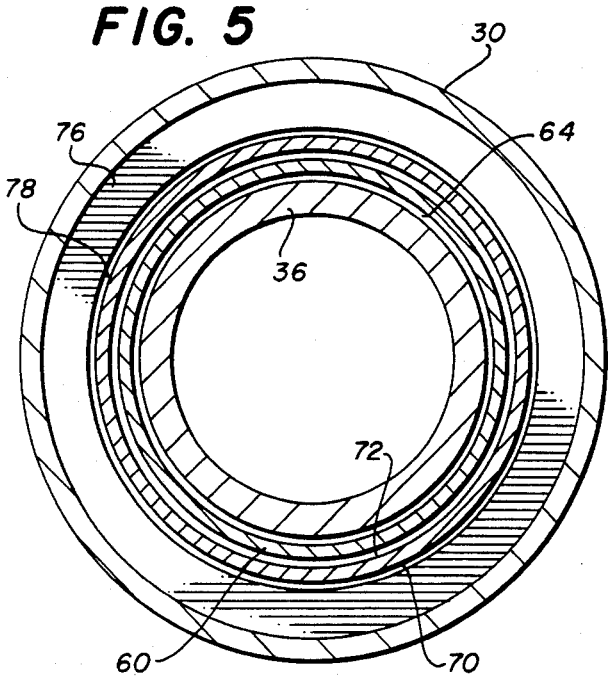
Figure 6:
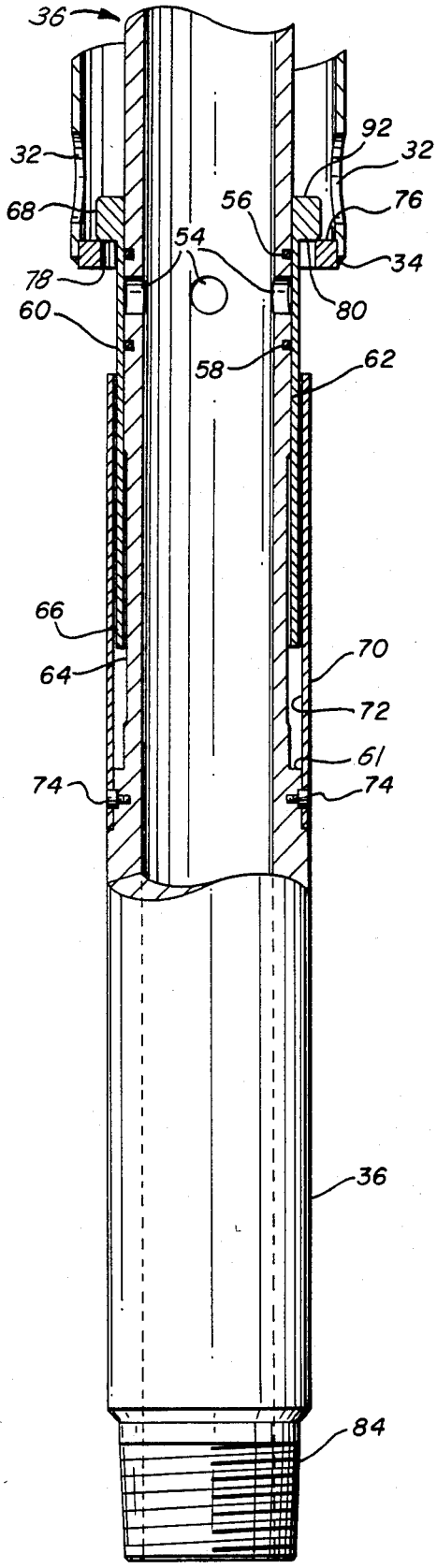
FIG. 6 is a fragmentary, part cross-sectional view which discloses part of the apparatus shown in FIG. 3, with some parts thereof being moved to an alternate position.

FIGS. 3 and 6 disclose some additional details of the before mentioned packer actuated vent assembly 14 of the present invention. As seen in FIG. 3, together with FIGS. 4–6, upper edge portion 31 of the outer barrel 30 of the vent assembly 14 is threadingly engaged with the lower end of the packer body 20 of the retrievable packer 12. The packer often includes a J-latch 46, as is known to those skilled in the art. J-latch 46 is used to hook on and set packer 12. An axial passageway 48 extends centrally through the outer barrel 30. The mandrel extension 36 is concentrically arranged with respect to the outer barrel 30 and forms an annular area 52 therebetween. Ports 54 are formed within the sidewall of the mandrel extention 36 and provide a flow path along which fluid can flow from the annulus 52 into the interior of the mandrel extension 36 and vice versa.

O-rings 56 and 58 are spaced from one another along alternate sides of ports 54 and are housed in grooves which circumferentially extend about the mandrel extension 36. A slidable valve element 60 has an inside surface area made in close tolerance slidable relationship with respect to the outer circumferentially extending sealing surface 62 of the mandrel extension 36. As best seen illustrated in FIG. 6. the sealing surface 62 preferably is formed along a medial portion of the exterior of the mandrel extension 36 so as to provide ample room for a seal between extension 36 and valve element 60, and at the same time reduce friction to a minimum by the provision of an undercut area at 64 around the medial portion of mandrel extension 36.

The lower end 66 of the valve element 60 is abuttingly received against the illustrated circumferentially extending shoulder 61 of extension 36. A boss 68 is formed at the upper end of the valve element 60 for reasons hereinafter described.

As seen in FIGS. 3, 5, and 6, a protective sleeve 70 is provided with an inside diameter 72 which is greater than the outside diameter of valve element 60, and therefore forms an upwardly opening cavity within which the before-mentioned valve element 60 is slidably received. The outer protective sleeve 70 serves to guard, shield, and protect valve element 60 thereby preventing material from accidentally hanging on valve element 60 before one is ready for boss 68 to engage internal shoulder 76 to close the vent assembly 14. Sleeve 70 also protects against debris fouling valve element 60. Fastener means 74 maintains the protective sleeve 70 in fixed relationship with respect to the mandrel extension 36.

Lower cylindrical shoulder 76 is rigidly affixed to the inside surface of the lower terminal end of the outer barrel 30. The inside diameter of the shoulder 76 is slightly spaced at 78 from the outer peripheral wall of the mandrel extension 36. The face of the shoulder 76 abuttingly engages face 80 of the boss 68 in order to move the valve element 60 into the closed position.

Lower radial port 32 forms a flow passageway for well fluid to flow into annulus 52, whereupon the fluid can proceed up the annulus 52 and into open ports 54, when ports 54 are in the open position.

As seen in FIG. 2, together with FIGS. 3 and 6, the lower threaded end 84 of the mandrel extension 36 connects sub or coupling 37 to the pipe string 38, as may be required in order to assemble additional tools downhole of the packer actuated vent assembly 14. Upper threaded surface 86 of the mandrel extension 36 is connected to the lower threaded end of the mandrel 88 of the retrievable packer 12. Mandrel 88 presents a lower shoulder 90 which abuttingly engages shoulder 92 of boss 68 of the valve element 60, in the event the element 60 should be moved to its extreme upward limit of travel, whereupon, lower end 66 of the valve element 60 continues to cover both of the O-rings 56 and 58. The dot-dash numeral at 94 indicates an auxiliary port formed within the outer barrel 30, if desired. Port 94 has the same purpose as ports 32 in the lower part of the barrel 30, i.e. to provide additional flow area into tubing string 9.

As particularly seen in FIG. 2, a second vent assembly 39 is connected in underlying relationship with respect to the packer actuated vent assembly 14 and is further included in the tool string above jet perforating casing gun 42 such as that described in U.S. Pat. No. 3,706,344 or U.S. Pat. No. 4,140,188. Vent assembly 39 may include and incorporate any number of vent assemblies such as shown in U.S. Pat. No. 4,151,880, U.S. Pat. No. 4,299,287, and U.S. patent application Ser. No. 166,547 filed July 7, 1980. The bar actuated vent assembly disclosed in U.S. Pat. No. 4,299,287 is preferred. A second vent assembly is required so that tubing string 9 may be opened to the flow of production fluid prior to the detonation of the perforating gun. Thus, the tool string set forth in the embodiment of the invention illustrated in FIG. 2 includes two vent assemblies; that is, the packer actuated vent assembly 14, which is run into the well open, and another vent assembly 39, which is run into the well closed. Vent assembly 14 is closed during the setting of packer 22; therefore, prior to perforation, the closed vent assembly 39 is opened for accomodating any subsequent flow of production fluids from formation 43. The present invention is not restricted to any specific type of vent assembly 39. The vent assembly 39 can be pressure operated, mechanically operated, or slick line operated.

Further, a pop-out vent assembly such as that shown and escribed in U.S. patent application Ser. No. 384,508 filed June 3, 1982 entitled "Gun Below Packer Completion Tool String", can be used as vent assembly 39. Such a pop-out vent assembly includes a vertical frangible disc mounted in the tubing string whereby the pop-out vent assembly collapses upon a predetermined pressure differential being achieved across the tubing string. For example, as the pressure differential across the tubing string reaches 300 psi, the frangible disc collapses and opens the tubing string to production flow. The pop-out vent can also be actuated by circulating nitrogen down the tubing string, setting the packer, and bleeding off the nitrogen pressure until the desired underbalance is achieved at which time the pop-out vent collapses, opens the tubing string to flow, backsurges the perforations upon perforating, and permits the production fluids to flow into the tubing and up to the surface. Also, the desired differential pressure to open the pop-out vent can be achieved by swabbing the tubing string.

In carrying out the method of the present invention, the tool string illustrated in FIGS. 1 and 2 is assembled in the usual manner. The remaining components of the pipe string 38 are connected at threaded surface 84 for lowering the tool string downhole into the borehole 10. At this time, ports 54 of the packer actuated vent assembly 14 are in the illustrated open position of FIG. 3. Accordingly, as vent assembly 14 passes below the level of well fluids in the borehole 10, well fluids are free to flow into tubing string 9 thereby creating a hydrostatic head. Thus, the hydrostatic head within tubing string 9 and well annulus 52 are maintained equal to one another since the well fluids are free to flow between the tubing interior and the annulus 52. By maintaining a substantially constant hydrostatic head in borehole 10, the producing well remains killed since the hydrostatic head remains greater than the formation pressure. Further, if the well starts "kicking", well fluid may be circulated down the tubing string and through vent assembly 14 to kill the well at any time. Further, it may be desirable to circulate through vent assembly 14 as the string is lowered into the well where well fluids have been permitted to settle and possibly compact within the cased borehole 10.

Prior to setting the packer, it may be desirable to create a predetermined underbalance on the formation. This may be accomplished by pumping fluid, such as diesel or light production, down the tubing string to displace the well fluids in the tubing string through the vent assembly. The hydrostatic head in the tubing string can also be controlled by displacing the fluid in the tubing string with nitrogen whereby after vent assembly 14 is closed, the nitrogen can be bled out of the tubing string 9 to obtain the desired hydrostatic head for achieving the desired pressure differential for backsurging. Another method includes closing vent assembly 14 and swabbing it dry to reduce the hydrostatic head to achieve the desired unbalance. In summary, the desired underbalance can be obtained by replacing the well fluids in the tubing string with a lighter fluid and closing vent assembly 14 or by first closing vent assembly 14 and swabbing tubing string 9 substantially dry.

After packer 12 arrives at a location which positions perforating gun 42 adjacent to the formation 43 and the hydrostatic head in tubing string 9 is reduced to achieve the desired underbalance, packer 12 is set by manipulating upper tubing string 9 which in turn manipulates packer mandrel 88 setting packer 12 and slips 24, 26. Once the seals 22 of packer 12 are set, it is now safe to perforate the old formation or to perforate a new formation As the packer mandrel 88 is manipulated, either by turning or by directly setting down, the packer mandrel 88 moves downhole relative to the packer body 20, carrying the packer mandrel 88 therewith until face 80 of boss 68 abuttingly engages the face of shoulder 76. As the mandrel extension 36 continues to move downhole, the valve element 60 is moved from the illustrated position of FIG. 3 into the dot-dash position 68', which is also the position seen illustrated in FIG. 6.

This action moves the valve element 60 into closed relationship relative to ports 54 so that well fluids cannot flow from the interior of the tubing string 9 outward or inward from the annulus 52.

Depending upon the well environment, the desired pressure differential may be achieved at this time by bleeding off nitrogen in the tubing string or by swabbing fluid out of the tubing string to obtain a predetermined hydrostatic head in the tubing string.

A suitable bar is dropped down through the tubing string 9 and travels through the upper tubing string, through the retrievable packer mandrel 88, through the mandrel extension 36 of the vent assembly 14, and through the second vent assembly 39, whereupon the bar engages and moves the valve element of vent assembly 39 to cause the port 40 to assume the open position. The bar continues to travel downhole and is arrested by the gun firing head of the perforating gun 42, whereupon the shaped charges thereof are detonated, and the casing 7 perforated. This forms a flow path along which hydrocarbons from formation 43 can then flow through the perforations, into the lower casing annulus, uphole into port 40 of the vent assembly 39, uphole through the packer actuated vent assembly 14, through the packer 12, and uphole through the tubing string 9 to the top of the ground where the production is gathered in the usual manner.

While a preferred embodiment of the invention has been shown and described, modifications thereof can be made by one skilled in the art without departing from the spirit of the invention.

I claim:

1. In a packer device adapted to be anchored downhole in a borehole, and having a mandrel axially movable respective to a packer body for setting a packer element against the borehole wall, with a tubing string connected to the mandrel for conducting fluid flow from a location below the packer to the surface of the ground, in combination;

a packer actuated vent assembly, said vent assembly includes a hollow mandrel extension connected to the packer mandrel, a sliding valve means, and a barrel;

said mandrel extension, sliding valve means, and barrel are concentrically arranged respective to one another, with said sliding valve means slidably engaging a marginal length of said mandrel extension in sealed relationship therewith, and with said barrel being radially spaced from said sliding valve means and from said mandrel; aperture means in said marginal length of said mandrel extension by which a flow path is formed from the interior to the exterior thereof;

means by which the upper end of said mandrel extension and barrel, respectively, can be attached to the lower end of the packer mandrel and packer body, respectively;

means on said barrel for engaging and moving said sliding valve means from a flow permitting to a flow preventing position when said mandrel extension is moved relative to said barrel;

so that when the packer is set by moving the mandrel of the packer relative to the packer body, said mandrel extension is moved relative to said barrel, causing said means on said barrel to move said sliding valve means to the flow preventing position.

2. The packer actuated vent assembly of claim 1 wherein said sliding valve means includes a valve element in the form of a cylindrical sleeve which is slidably received in sealed relationship about a marginal length of said mandrel extension; and, said aperture means being misaligned with said sleeve when said sleeve is moved into the flow permitting position; said aperture means being aligned with said sleeve when said sleeve is moved to the flow preventing position;

and a protective cylinder positioned in fixed relationship to said barrel and about said sleeve to form an upwardly opening annular cavity;

said means on said barrel for engaging and moving said valve means includes an annular shoulder, said shoulder and said sleeve being positioned relative to one another so that the movement of the packer mandrel in setting the packer imparts movement into the mandrel extension for moving the sleeve into the flow preventing position.

3. The packer actuated vent assembly of claim 1 wherein said sliding valve means includes a cylindrical sleeve which is slidably received in sealed relationship about said marginal length of said mandrel extension; said aperture being aligned with said sleeve when said sleeve is moved into the flow preventing position, and said aperture means being misaligned with said sleeve when said sleeve is in the flow permitting position.

4. The packer actuated vent assembly of claim 3 wherein said means on said barrel for engaging and moving said valve means is a shoulder means, said shoulder means and said sleeve being positioned relative to one another so that the movement of the packer mandrel in setting the packer imparts movement into the mandrel extension, which in turn moves the sleeve into the flow preventing position.

5. The packer actuated vent assembly of claim 3 wherein said sleeve is provided with a boss, said boss has a face which engages said shoulder and moves said sleeve when the mandrel is moved downhole relative to the barrel.

6. A packer actuated vent assembly comprising a packer device having an outer body, a packer element, a hollow mandrel, and means by which the packer device can be anchored downhole in a well bore by manipulating said mandrel relative to the packer body, thereby setting the packer element and precluding fluid flow across the packer device;

a barrel attached to and extending from the outer body, a hollow mandrel extension attached to and extending from said hollow mandrel in series flow relationship therewith, aperture means in the sidewall of said mandrel extension for forming a flow path from the interior to the exterior thereof; a valve element in the form of a sleeve slidably received about said mandrel extension for causing a fluid flow path to be formed from without to within said mandrel extension when said valve element is moved from a flow preventing to a flow permitting position;

and means responsive to relative movement between said barrel and said mandrel extension for moving said valve means from said flow permitting to said flow preventing position.

7. The packer actuated vent assembly of claim 6 wherein said sleeve is cylindrical in form, said sleeve is slidably received in sealed relationship about a marginal exterior length of said mandrel extension, said aperture means forming at least one port in said mandrel extension, said port being aligned with said sleeve when the sleeve is moved into the flow preventing position, said port being misaligned with said cylindrical sleeve, when the sleeve is in the flow permitting position;

said means responsive to relative movement between said barrel and said mandrel extension is a shoulder means located on said barrel; a boss on said sleeve for engaging said shoulder means, said shoulder and said boss being positioned relative to one another so that movement of the hollow mandrel while setting the packer device imparts movement into the mandrel extension for moving the cylindrical sleeve from the flow permitting position to the flow preventing position.

8. The packer actuated vent assembly of claim 6 wherein said sleeve is cylindrical in form and is slidably received in sealed relationship about the marginal exterior length of said mandrel extension, said aperture means comprising apertures formed in said marginal length of said mandrel extension, said apertures being aligned with said sleeve when said cylindrical sleeve is moved into the flow preventing position, said apertures being misaligned with said sleeve when said sleeve is in the flow permitting position.

9. The packer actuated vent assembly of claim 8 wherein said means responsive to relative movement between said barrel and said mandrel extension is a shoulder means located on said barrel, a boss on said sleeve for engaging said shoulder, said shoulder and said boss being positioned relative to one another so that movement of the hollow mandrel while setting the packer device imparts movement into the mandrel extension for moving the sleeve from the flow permitting to the flow preventing position.

10. The packer actuated vent assembly of claim 8 wherein a protective cylinder is positioned about said valve element and forms an upwardly opening annular cavity within which the valve element is protectively received.

11. A packer assembly for being anchored downhole in a borehole and having a hollow mandrel axially movable respective to a packer body for setting a packer element against the borehole wall, with a tubing string being connected to the mandrel for conducting fluid flow from the lower borehole to the surface of the ground, the combination with said packer assembly of a packer actuated vent assembly; said vent assembly includes a hollow mandrel extension, a sliding valve element, an outer barrel, and an actuator for moving said sliding valve element;

said mandrel extension, sliding valve element, and barrel being concentrically arranged, with said sliding valve element slidably engaging a marginal, longitudinally extending, medial length of said mandrel extension in sealed relationship therewith; an aperture formed through a sidewall of said mandrel extension, said barrel being radially spaced from said sliding valve element and from said mandrel; an annular area formed between said mandrel extension and said barrel within which said valve element is received and within which the valve element can be moved from an opened to a closed position;

means by which said mandrel extension and barrel, respectively, can be attached to the packer mandrel and packer body, respectively;

said actuator being an inwardly directd shoulder formed on said barrel for engaging and moving said sliding valve element from a flow permitting to a flow preventing position when said mandrel extension is moved relative to said barrel;

so that when the packer is set by moving the mandrel of the packer relative to the packer body, said mandrel extension is moved relative to said barrel, causing said shoulder on said barrel to move said sliding valve element from the flow permitting to the flow preventing position; whereupon fluid flow cannot occur from the interior of the mandrel extension, through said aperture, and into said annular area.

12. An assembly for preventing flow into a tubing string extending into a cased borehole filled with well fluids, comprising:

a mandrel series connected to the tubing string at a predetermined location;

a barrel disposed on the tubing around said mandrel;

anchor means for releasably anchoring said barrel to the cased borehole and preventing said barrel from moving downward into the well with the tubing string and mandrel;

said mandrel having apertures therethrough permitting the flow of well fluids into the tubing string as the tubing string is lowered into the well;

barrier means movably disposed on said mandrel from an open position permitting fluid flow through said apertures to a closed position preventing fluid flow through said apertures upon the downward movement of said mandrel after said barrel is anchored in the cased borehole by said anchor means.

13. The assembly of claim 12 wherein said barrier means includes a sliding element engaging a marginal length of said mandrel in sealed relationship therewith and including means on said mandrel for reducing the engagement between said sliding element and said mandrel.

14. The assembly of claim 13 and including a protective sleeve over the substantial length of said sliding element.

15. The assembly of claim 13 wherein said barrier means includes an inwardly projecting shoulder on said barrel, sand said sliding element including an outwardly projecting shoulder, said sliding element shoulder engaging said barrel shoulder upon the movement of said mandrel relative to said barrel.

* * * * *